US005897064A

United States Patent [19]

Rupp

[11] Patent Number: 5,897,064

[45] Date of Patent: Apr. 27, 1999

[54] ICE SHAVING MACHINE

[76] Inventor: Cheryl L. Rupp, 5150 Alvera Dr., Holladay, Utah 84107

[21] Appl. No.: 09/017,242

[22] Filed: Feb. 2, 1998

[51] Int. Cl.[6] ..... B02C 19/12

[52] U.S. Cl. ..... 241/92; 241/DIG. 17

[58] Field of Search ..... 241/DIG. 17, 92, 241/278.1

[56] References Cited

U.S. PATENT DOCUMENTS

| | | | |
|---|---|---|---|
| 4,394,984 | 7/1983 | Hight et al. | 241/DIG. 17 |
| 4,575,012 | 3/1986 | Uphoff et al. | 241/DIG. 17 |
| 4,655,403 | 4/1987 | Sciortino | 241/DIG. 17 |
| 5,050,809 | 9/1991 | Rupp | 241/DIG. 17 |

*Primary Examiner*—Mark Rosenbaum
*Attorney, Agent, or Firm*—M. Reid Russell

[57] ABSTRACT

A block ice shaving machine having an outer housing with an insulative inner housing fitted therein that a block of ice is positioned on a bottom surface, and included a rotary cutter housing mounted to one end of the inner housing that includes a rotary cutter that is turned by an electric motor and including a push bar maintained in the inner housing to be moved by operation of a chain drive so as to urge the block of ice against blades of the turning rotary cutter, to shave sections or strips of ice off from the block of ice, with the ice shavings directed out of a discharge chute to be captured in a container and receive a sweet syrup thereover for human consumption. The push bar is driven forward or backward by a sprocket system whose rate of turning is manually controlled by a sprocket and clutch assembly.

9 Claims, 5 Drawing Sheets

ICE SHAVING MACHINE

BACKGROUND OF THE INVENTION

1. Field of the Invention

This invention relates to machines for shaving ice for use in making cones of ice and the like to which flavoring is added.

2. Prior Art

Ice chips shaved from a block of ice have long been used for manufacture of deserts and confectionaries. Commonly, such ice chips or shavings are collected into a holder and a syrup of desired flavor, or combination of flavors, is poured over the top of the ice to provide sweetening and desired taste.

In the past, a great many devices have been proposed to provide a desired consistence of ice chips for ice shavings confectionaries. Hand held and operated devices are well known and have been used for many years. Such devices generally comprise a holder for a knife blade or blades that are drawn, turned, or the like, across a block of ice or in some instances, larger, bulkier, devices have been used to crush a larger block of ice. More recently, machines have been proposed that will allow a block of ice to be held in a fixed position moved into engagement with automatically operated cutter blades that are pulled or turned across a surface of the block of ice to produce ice shavings. The ice shavings are then collected and are thereafter scooped into a cone shaped container, such as one that is formed from paper or the like, and a syrup is poured over the contained ice.

Presently, there remains a continuing need for a machine that will reliably provide a uniform consistency of ice shavings to better receive syrup poured over them and provide an attractive appearance to consumers. Also, there remains a need for a machine that is safe and easy for an operator to use and control, that allows the operator to selectively control travel of a block of ice into a turning blade, that includes a unique blade mounting arrangement and provides for direct filling of the containers in which the confectioneries are to be marketed.

SUMMARY OF THE INVENTION

Principal objects of the present invention are to provide a durable, easily operated and controlled, and easily cleaned ice shaving machine.

Another object is to provide a machine that is compact, easily relocated from place to place, that will produce uniform ice shavings utilizing a controlled feeding of a block of ice into a rotating cutter head, and will provide a constant and uniform pressure application to the ice to urge it into the turning cutter head.

Still another object of the present invention is to provide a device for efficiently shaving ice off from that block with the rotating cutter head that includes an arrangement of individual blade mountings that each hold a blade at a desired angle to the cutter head and are reliable and easily operated.

Principal features of the housing include a housing arranged to conveniently receive a block of ice positioned on a movable platform therein; a cutter blade assembly that is arranged to turn across one end of the housing and has a discharge chute for discharging ice shavings from the housing; and a motor driven pressure application ram that is turned on by a switch and is arranged to be controlled by an operator setting a sprocket and clutch assembly to insure a controlled uniform application of force to the ice to feed it at a desired rate into the cutter blade assembly.

Other features include a drive motor and linkage to the cutter head that includes an efficient and blade mounting and a cutter head housing mounting arrangement.

Other objects and features of the invention will become apparent from the following detailed description and drawings, disclosing what is presently contemplated as being the best mode of the invention.

DESCRIPTION OF THE DRAWINGS

In the drawings that represent the best mode presently contemplated for carrying out the invention.

DETAILED DESCRIPTION

Figure 1:
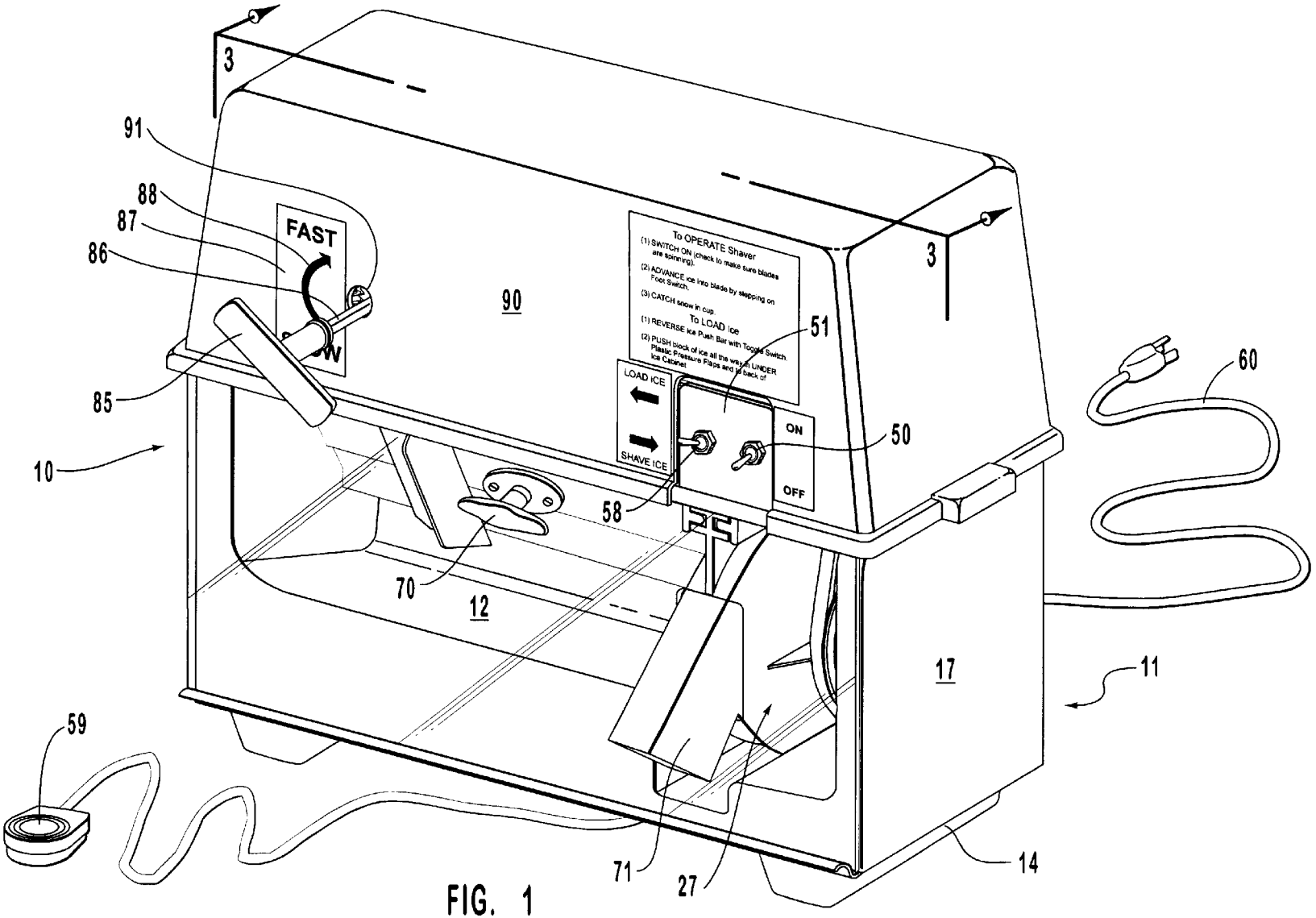
FIG. 1 is a perspective view of the ice shaver machine of the invention showing it as having a transparent front cover that is shown closed.

A preferred embodiment of an ice shaving machine 10, is shown in the drawings to include a housing 11 with a front panel 12 that has a bottom edge 12*a* for fitting behind a lip 13 to pivot there around. The housing 11, as shown best in FIG. 2, includes a bottom 14 with feet 14*a* formed along opposite sides, with a front face 15 shown open to provide an access opening 16 that is closed over by front panel 12, and with end walls 17 and 18, and rear wall 19.

Figure 3:
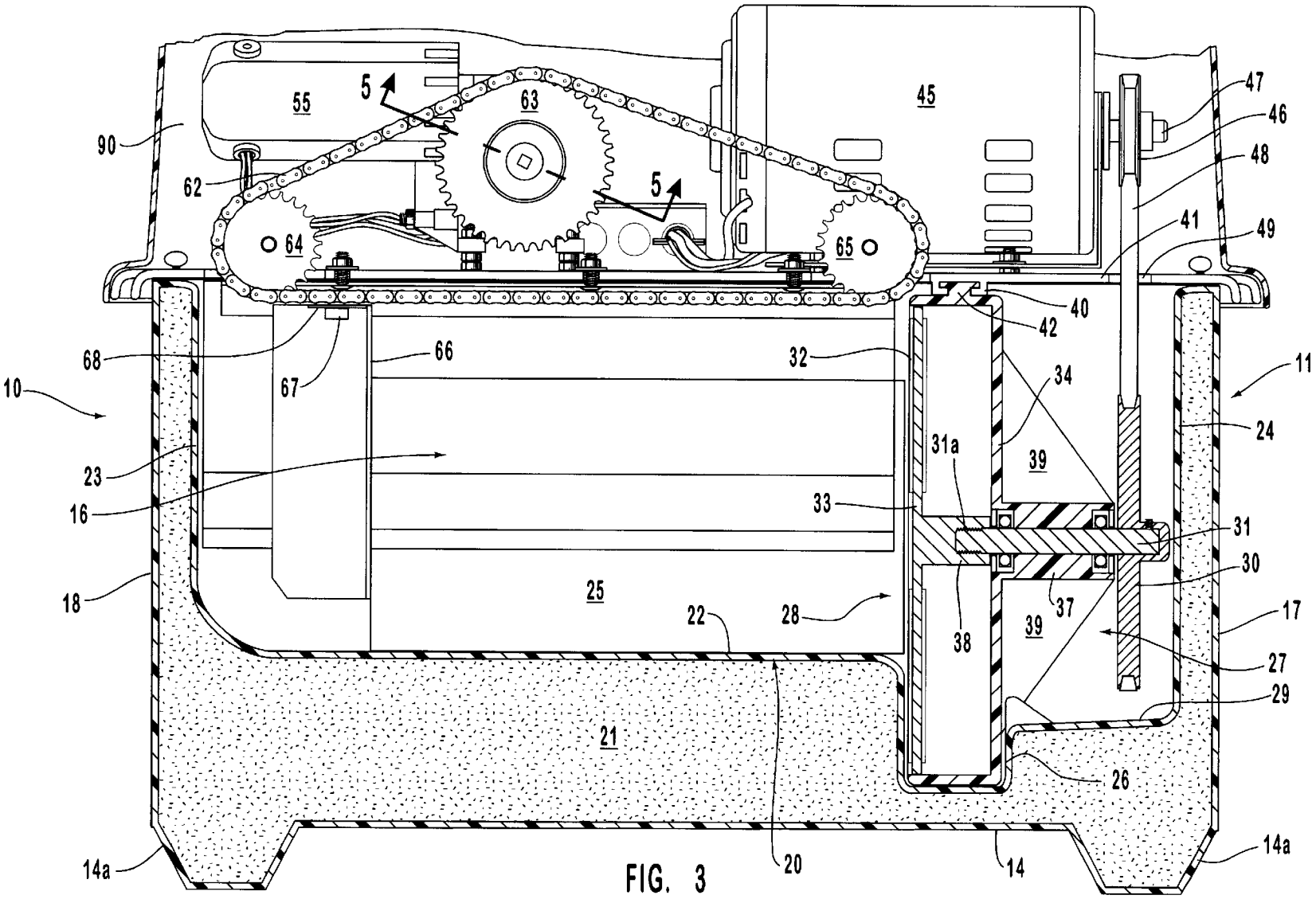
FIG. 3 is a sectional view taken along the line 3—3 of FIG. 1.

The housing further includes an inner shell 20, shown in FIG. 3, seated upon the housing 11 bottom that preferably contains insulation 21 and includes a bottom surface 22, inside end walls 23 and 24, and an inside rear wall 25.

Figure 4:
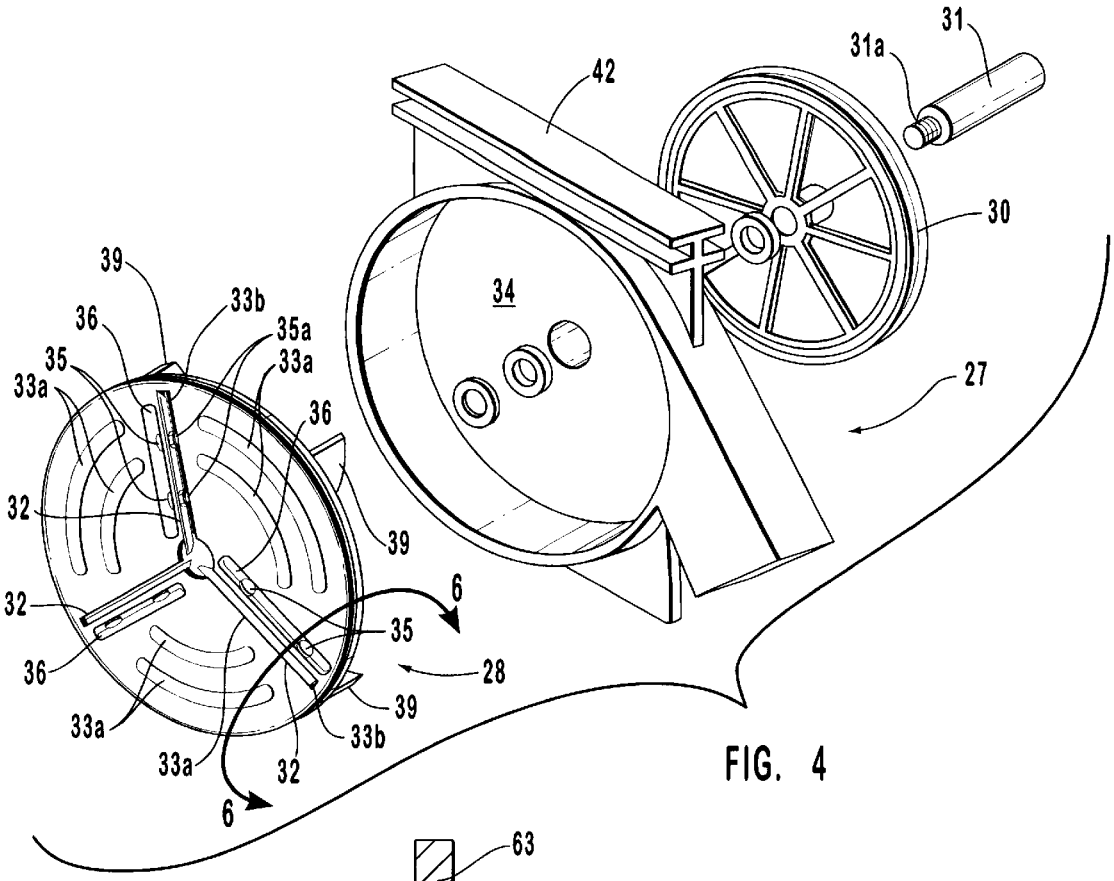
FIG. 4 is an enlarged exploded view of a cutter blade and its housing and showing the housing mounting removed from the ice shaver machine.

A deep recess 26 is formed in the inside bottom surface 22 to receive and securely hold the cutter housing 27, shown in FIGS. 1 through 4, that contains a rotary cutter 28, as shown best in FIG. 4. A shallow recess 29 is provided in the housing bottom surface 22, adjacent to the deep recess 26 to provide clearance for a pulley 30 that is fixed to a shaft 31 that carries a mounting plate 33 for cutting blades 32 and is positioned adjacent to turn over a backing plate 34 of the cutter housing 27. The blades 32 are connected as shown best in FIGS. 4 and best in 6, by bolts 35 whereover nuts 35*a* are turned that have been fitted through an angled mount step 36 that is formed in the mounting plate 33 that also includes a slot 36*a* wherethrough the bolt 35 is fitted to pass through a hole 32*a* in blade 32 and receives nut 35*a* turned thereover. In practice, each blade 32 preferably includes a pair or more of holes 32*a* to each receive a bolt 35 fitted therethrough, with the blades are thereby individually mounted to extend approximately thirty (30) degrees to the face of the mounting plate 33, though it should be understood, an angle of between fifteen (15) and forty five (45) degrees could be used, with each blade to extend to a cutting edge of each at an optimum cutting angle, shown herein as just above the face of mounting plate 33. The cutting edges are thereby to engage a flat surface of a cube-shaped block of ice as set out below. Shaft 31, as shown in FIG. 3, is journaled through a bearing block 37 that connects at a right angle to extend from the backing plate 34, with the shaft 31 including a threaded end 31*a* that is turned into a center sleeve 38 of the mounting plate 33.

Figure 2:
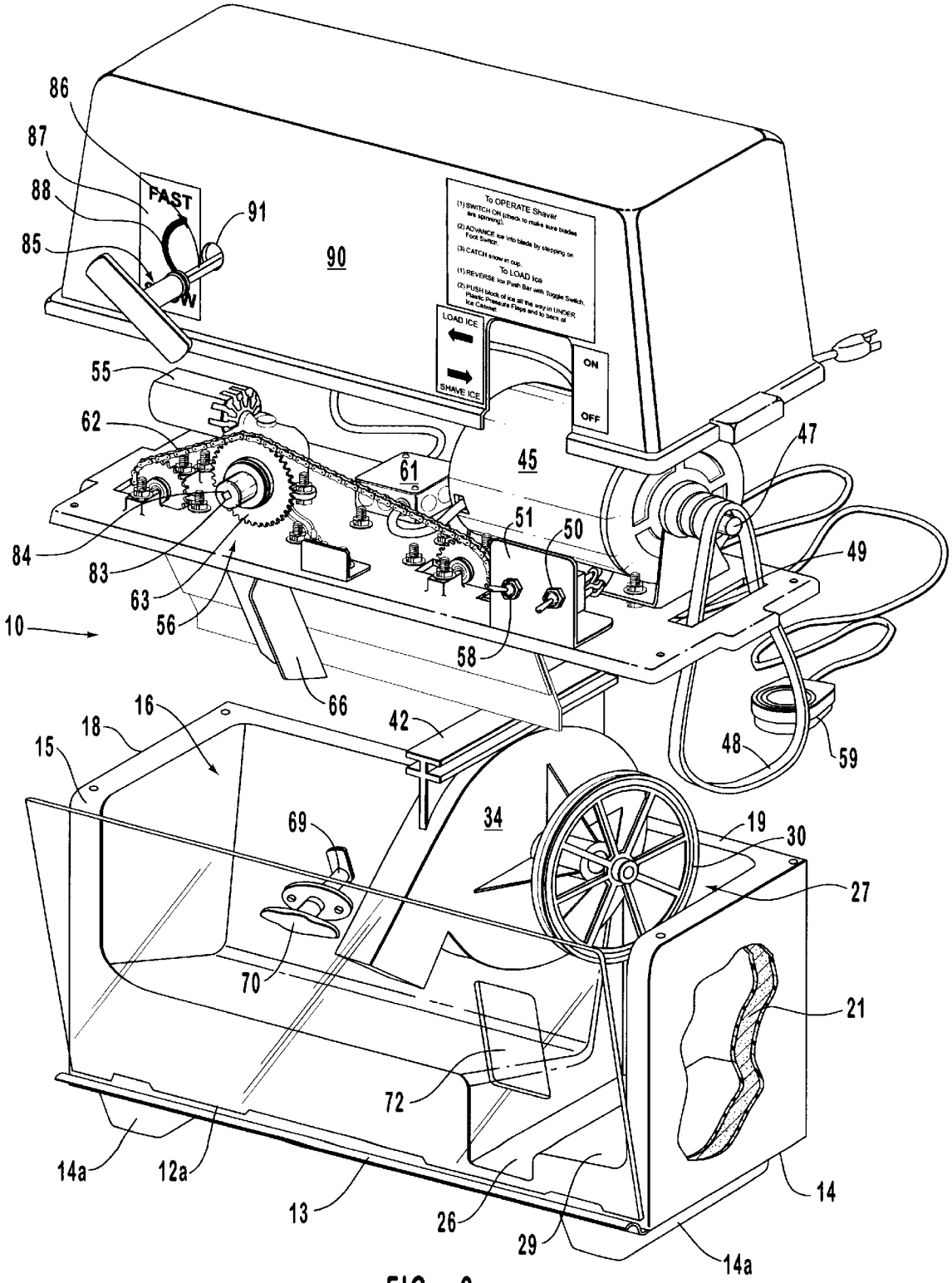
FIG. 2 is an exploded perspective view of the ice shaver machine of FIG. 1.

Spaced vanes 39 radiate from near the center of the mounting plate 33 to an outer edge thereof, extending across a rear face of the mounting plate 33, which mounting plate is slotted at 33*a* to pass ice shavings produced at the blade cutting edges that travel into a cavity in front of backing plate 34 and are engaged by the vanes 39 that direct the shavings out of a discharge chute 71 from the cutter housing 27, that is shown best in FIGS. 1 and 2.

A guide channel 42 as shown in FIG. 3, is carried by a slot 40 that is secured across the undersurface of a top plate 41, shown in FIGS. 2 and 3, that fits over the housing 11. Which top plate 41, as shown, is bolted to or otherwise fixed between the housing end walls 17 and 18 and rear wall 19. The guide channel 42, as shown, is configured to fit in slot 40, which is slot 40 is a channel section secured to the top of the cutter housing 27, with the guide channel to slide freely and is securely held in the slot 40, securing the cutter housing 27 in position, as shown in FIGS. 1 and 3.

An electric motor 45 is shown in FIGS. 2 and 3 mounted on to the upper surface of top plate 41 that includes an output shaft 47 whereon a pulley 46 is secured with a drive belt 48 shown extending through an opening 49 formed in top plate 41, the drive belt 48 to interconnect to the pulley 30 of the rotary cutter 29 to the pulley 46.

A toggle switch 50 is shown mounted to extend from a bracket 51 that is secured to the top plate 41, with the toggle switch 50 operated to turn on or off the motor 45, driving the rotary cutter 28.

Figure 5:
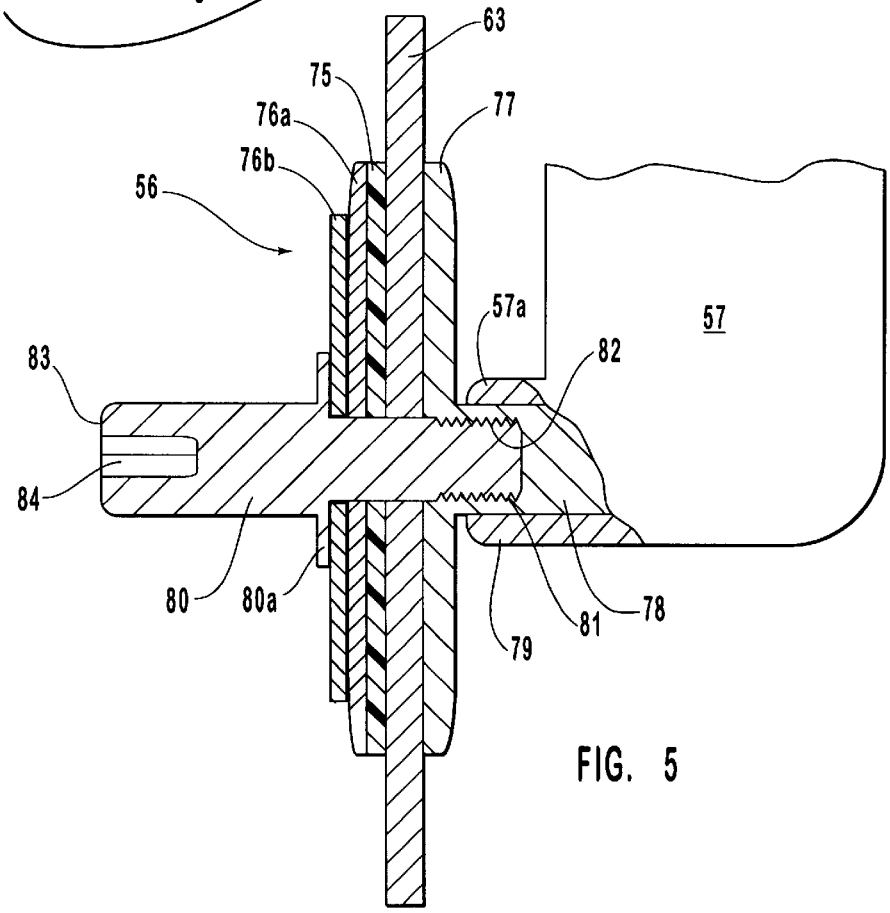
FIG. 5 is a sectional view taken along the line 5—5 of FIG. 3.
Figure 6:
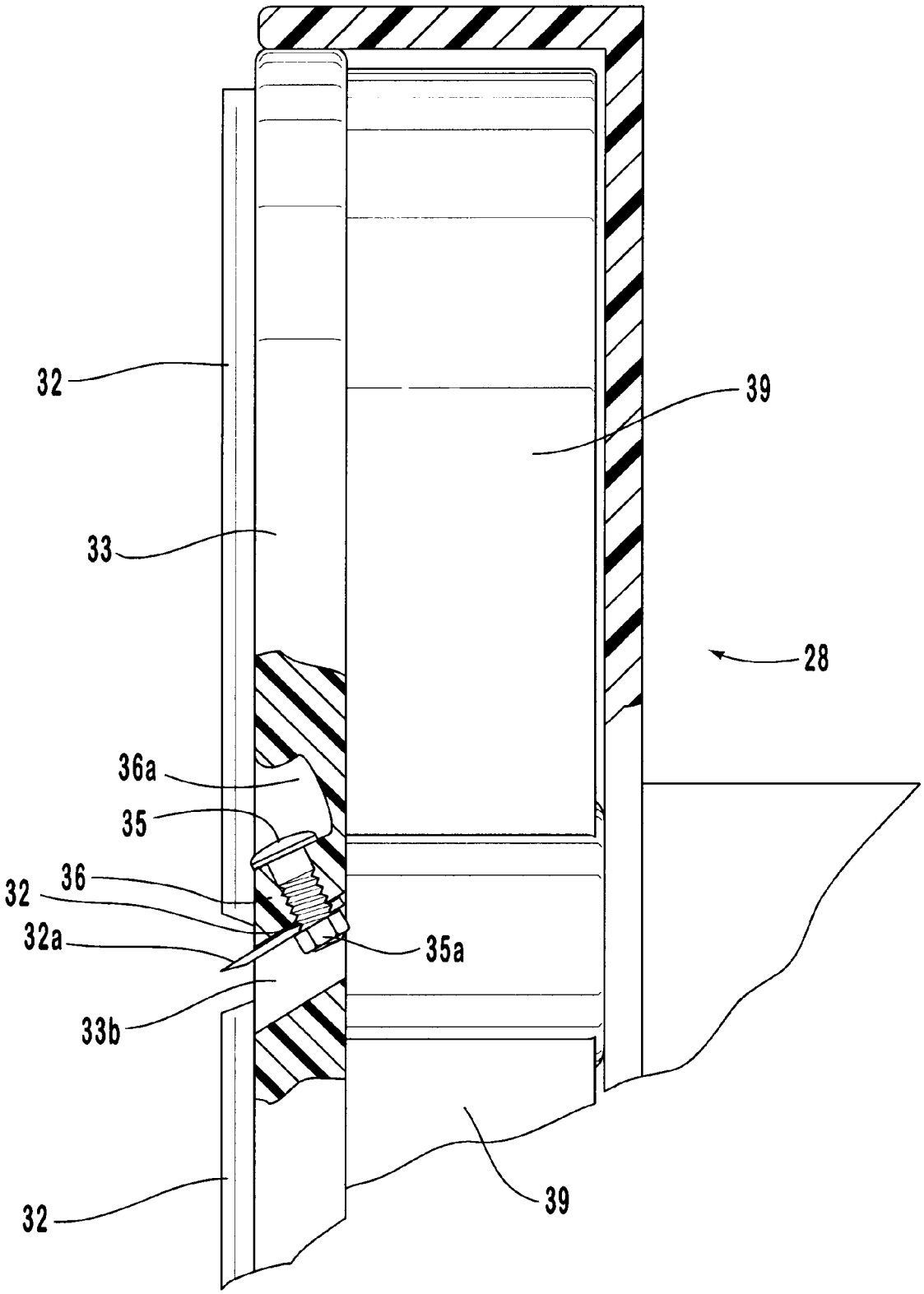
FIG. 6 is an enlarged sectional view taken within the line 6—6 of FIG. 4 showing an individual blade mounting to the cutter head.

Another or second electric motor 55, shown in FIGS. 2 and 3, is also mounted, through a transmission, shown in FIG. 5, to the upper or top surface of the top plate 41. Motor 55 is provided to drive a sprocket and clutch assembly 56, shown in FIG. 2, through transmission 57, set out and described in detail hereinbelow, which motor 55 is turned on or off by a second toggle switch 58 that is mounted to bracket 51, and which motor 55 is controlled, to turn in either a forward or reverse direction, by an operation of a foot control switch 59, shown in FIG. 1. Power to the switches 50 and 58, and foot control switch 59 is provided through a usual cord and plug 60 that is electrically connected through a box 61, shown in FIG. 2.

Shown in FIGS. 2 and 3, a chain 62 is entrained over a sprocket 63 of the drive sprocket and clutch assembly 56, shown also in FIG. 5, and a pair of spaced apart sprockets 64 and 65, shown in FIG. 3, are also carried on top plate 41, with each sprocket 63 and 64 extending partially through the top plate. A push bar 66, shown in FIGS. 2 and 3, is fixed to chain 63 by a clamp 67, shown in FIG. 2, that is maintained inside housing 11, extends from the chain 62 and is fitted through and secured to a flange top end of the push bar 66, thereby mounting the push bar 66 to extend at a right angle from the chain 63.

In practice, with the switch 58 turned on, the foot pedal 59 is first operated to reverse operation of motor 55 to move push bar 66 to an end of housing 11 that is remote from the rotary cutter 28. A block of ice, not shown, is placed on bottom 22 and door 12 is closed and locked using a latch 69 that is journaled though front panel 12 and is turned by handle 70. When the front panel 12 is closed a discharge chute 71 from cutter housing 27 will extend through an opening 72 that is provided in the front panel 12.

The motor 45 is turned on using switch 50, turning the rotary cutter 28. Foot switch 59 is then pressed to operate motor 57 in a forward direction, causing push bar 66 to engage and slide the block of ice towards the rotary cutter 28. The push bar 66 pushes the block of ice into engagement with the turning cutter blades 31 that shave slivers of ice off the block and discharge those ice shavings through mounting plate slots 33*a*. The shavings pass through the rear surface of mounting plate 33 and are engaged by the rotating vanes 39 that throw the ice shavings through chute 71. During motor 57 operation, the drive sprocket and clutch assembly 56, as set out below, is provided to control the pressure as is applied to the block of ice to drive it into the cutter blades 32.

Shown in FIG. 5, the drive sprocket and clutch assembly 56 includes the sprocket 63 having a somewhat resilient plate 75 fitted thereagainst that is sandwiched between an outer surface of the sprocket 63 and a stacked pair of outer plates 76*a* and 76*b*, and with an inner face of sprocket 63 in contact with a drive plate 77.

The drive flange 77 is an outwardly flanged end of a drive shaft 78 that is, in turn, journaled through an outlet port 79 of transmission 57. To sandwich the sprocket 63 between the resilient plate 75 and drive flange 77 a nut 80 threaded end 81 is turned into a threaded opening 82 that is formed through the center of flange 77 and into drive shaft 78, clamping the assembly together. For turning nut 80, an outer nut end surface 83 has a center sided hole 84 formed therein that is to receive a sided shaft 86 of a handle 85, shown in FIGS. 1 and 2. So arranged, turning handle 85 clockwise tightens the turning nut 80 to move a collar 80*a* thereof, shown best in FIG. 5, against outer plate 76*b* with that force transferred through inner plate 76*a* and into the resilient plate 75, clamping it against the sprocket 63 outer surface so as to improve a coupling efficiency of the sprocket 63 to the drive flange 77, causing the sprocket turning speed to increase. This is illustrated by the curved arrow 88 shown on a plate 87 that is fixed to housing cover 90 where through the side shaft 87 is fitted through a hole 91. When, however, the sided shift is turned counter clockwise pressure on the resilient plate 75 is lessened, decreasing coupling efficiency and causing the sprocket 63 to turn slower, as also illustrated by arrow 88. So arranged an operator turning handle 85 appropriately controls the speed a block of ice travels into engagement with the cutter blade 28 when the foot switch 59 is operated. The cover 90, as shown, is to fit over the components mounted onto the top plate 41.

In practice, an ice block face, not shown, will be urged against to engage the cutting edges of blades 32, that are individually maintained, as shown in FIG. 4, by bolts 35 with nuts 35*a* turned thereover, respectively. The blades 32 are individually mounted by fitting bolts 35 through holes formed through the angled mount step 36 and through blade holes 32*a*, securing each blade at a desired cutting angle distance beyond a cutting surface, the mounting plate 33 surface. The cutter blades 32 are thereby arranged to extend from radial slots 33*b* formed in the backing plate 33, which extension distance above the mounting plate 33 is adjustable by a repositioning of the blade 32 along blade hole 32*a*, that may be an elongate hole, and tightening of the nuts 35*a* on bolts 35.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A block ice shaver machine comprising, a housing having an inner bottom; a push bar; a reversible electric motor having an output shaft carried by the housing; means connecting the output shaft of the reversible electric motor to the push bar arranged within said housing and positioned above said housing bottom; drive sprocket and clutch means for adjusting speed of push bar travel; a rotary cutter having cutting blades, with each said blade having a cutting edge, which said blades are secured therein to said rotary cutter that is journaled at one end of the housing; means for maintaining each said cutting blade cutting edge a desired distance above a face of said rotary cutter; a second electric motor carried by said housing; means connecting said second electric motor to said rotary cutter, whereby operation of said second motor turns said rotary cutter; a door in said housing that provides access to the interior of said housing to allow a block of ice to be positioned in said housing to be pushed by said push bar into engagement with said cutting edges of said individual cutting blades of said rotary cutter; and a discharge chute means extending from the cutter housing outwardly of said housing for discharging shaved ice therethrough.

2. A block ice shaver machine as in claim 1, wherein the housing includes a bottom wall, spaced apart end walls, a rear wall, and an inner housing for fitting in said housing, which said inner housing includes an inner bottom surface, inner end walls and an inner rear wall; and said inner bottom and inner walls are separated from said housing bottom and side walls by an insulation material; and a top plate overlying said housing and inner housing walls.

3. A block ice shaver machine as in claim 2, further including a deep or first recess formed in the inner housing bottom wall to receive a rotary cutter housing; guide means secured onto a bottom surface of the top plate; and slide means secured onto said cutter housing to slide into and be held in said guide means.

4. A block ice shaver machine as in claim 3, where the slide means is a straight channel section.

5. A block ice shaver machine as in claim 3, further including a rotary cutter shaft whereon the rotary cutter is secured; and a pulley secured onto said rotary cutter shaft, and the means connecting the second electric motor to said rotary cutter includes a pulley that is secured onto an output shaft of the second electric motor; and a drive belt interconnecting said pulley secured onto said output shaft of said second electric motor and said pulley that is secured onto said rotary cutter shaft.

6. A block ice shaver as in claim 5, wherein the drive sprocket and clutch means that is coupled between the reversible electric motor and the means to reciprocate the push bar is a flat sprocket that is sandwiched between a flange end of the second motor drive shaft and a resilient plate and includes means for urging said resilient plate against a surface of said flat sprocket with another surface of said flat sprocket, in turn, urged against said flange, increasing the efficiency of said sandwiched coupling.

7. A block ice shaver as in claim 6, wherein the means for urging is at least one outer plate that is fitted against the resilient plate and further includes a nut means that is turned on a shaft that connects to a shaft driven by the second electric motor, urging said outer plate against said resilient plate; a pair of sprockets that are each carried by the top plate and extend partially into the housing; a chain that is fitted around the sprockets; and clamp means for securing the push bar to said chain.

8. A block ice shaver as in claim 1, wherein the means to maintain each cutting blade to the rotary cutter is a mounting plate that includes a plurality of radial slots formed therein and having, adjacent to each said radial slot, an angled mounting step formed in that mounting plate that has at least one hole formed therethrough, with said hole to receive a bolt fitted therethrough and through a hole in one of said cutting blades, which said bolt includes a bolt threaded end to receive a nut turned thereover.

9. A block ice shaver as in claim 8, wherein, a groove is formed in the mounting plate alongside the angled mounting step to provide access to allow for fitting one of the bolts through the hole in said angled mounting step.

* * * * *